US009771690B2

(12) United States Patent
Henke

(10) Patent No.: US 9,771,690 B2
(45) Date of Patent: Sep. 26, 2017

(54) QUICK CHANGE RAIL FASTENER DRIVING WORKHEAD UNIT

(71) Applicant: Nordco Inc., Oak Creek, WI (US)

(72) Inventor: Daniel Mark Henke, Hartland, WI (US)

(73) Assignee: NORDCO INC., Oak Creek, WI (US)

( * ) Notice: Subject to any disclaimer, the term of this patent is extended or adjusted under 35 U.S.C. 154(b) by 451 days.

(21) Appl. No.: 14/459,916

(22) Filed: Aug. 14, 2014

(65) Prior Publication Data

US 2015/0053449 A1 Feb. 26, 2015

Related U.S. Application Data

(60) Provisional application No. 61/867,874, filed on Aug. 20, 2013.

(51) Int. Cl.

| | |
|---|---|
| ***B25D 9/00*** | (2006.01) |
| ***B25D 11/00*** | (2006.01) |
| ***B25D 13/00*** | (2006.01) |
| ***E21B 1/00*** | (2006.01) |
| ***E01B 29/26*** | (2006.01) |

(52) U.S. Cl.

CPC ..... *E01B 29/26* (2013.01); *Y10T 29/49815* (2015.01)

(58) Field of Classification Search

CPC ..... E01B 29/26; B23Q 9/0042; B23Q 9/0007; B25B 5/082; B25B 5/101; B25B 21/00; B25B 21/002; B25B 25/005; E01D 6/00

USPC ..... 173/90, 93, 115, 128–129, 133, 137

See application file for complete search history.

(56) References Cited

U.S. PATENT DOCUMENTS

| | | | | |
|---|---|---|---|---|
| 3,552,320 | A * | 1/1971 | Traupmann | E01B 29/26 104/17.1 |
| 3,744,578 | A * | 7/1973 | Lisenby | E21B 7/00 173/19 |
| 4,200,978 | A * | 5/1980 | Irelan | A01D 34/416 30/276 |
| 4,446,930 | A * | 5/1984 | Nilsson | B25D 17/08 173/132 |
| 4,579,061 | A | 4/1986 | Dieringer | |
| 4,777,885 | A | 10/1988 | Dieringer | |
| 4,892,249 | A * | 1/1990 | Owen | E01C 9/04 238/8 |
| 5,170,561 | A * | 12/1992 | Sepke | A01D 34/4166 30/276 |
| 5,191,840 | A | 3/1993 | Cotic et al. | |

(Continued)

*Primary Examiner* — Robert Long

(74) *Attorney, Agent, or Firm* — Greer, Burns & Crain, Ltd.

(57) ABSTRACT

A fastener driving workhead unit is provided for performing an operation on spikes of a railroad track having a plurality of ties, and includes a hammer housing configured for accommodating a hammer, the housing being attached to a hammer bushing having a hammer bushing clamp. Also included in the workhead unit is an anvil assembly having an anvil and an extension coupler, the extension coupler being releasably secured to the hammer bushing by fastening the hammer bushing clamp. Further, the workhead unit includes a jaw assembly having a jaw block, the jaw block having at least one jaw block clamp for releasably securing a guide rod to the jaw block by the jaw block clamp, such that the anvil freely reciprocates in the hammer housing for driving the spikes into the plurality of ties.

16 Claims, 15 Drawing Sheets

(56) References Cited

U.S. PATENT DOCUMENTS 5,195,501 A * 3/1993 Ault ..... F23G 5/42 110/241
5,310,358 A * 5/1994 Johnson ..... G06F 1/1632 361/679.41
5,398,616 A 3/1995 Eidemanis et al.
5,671,679 A 9/1997 Straub et al.
6,315,059 B1 * 11/2001 Geldean ..... E21B 7/028 173/112
6,702,037 B1 * 3/2004 Thiessen ..... E02D 7/10 173/131
7,059,423 B1 * 6/2006 Hoggarth ..... B25D 11/06 173/114
7,104,200 B2 9/2006 Hosking et al.
7,387,173 B2 * 6/2008 Jinnings ..... E02D 7/10 173/147
7,682,102 B1 * 3/2010 Burke ..... E01C 19/35 404/133.05
8,136,774 B2 * 3/2012 Melittas ..... H01J 9/006 248/210
2005/0056485 A1 * 3/2005 Tarlow ..... E06C 7/14 182/129
2006/0213676 A1 * 9/2006 Jinnings ..... E02D 7/10 173/184
2011/0198104 A1 * 8/2011 Stockstill ..... B25D 17/02 173/128
2011/0308421 A1 * 12/2011 Pritzl ..... E01B 29/32 104/17.2
2013/0140053 A1 * 6/2013 Niekamp ..... E02D 7/08 173/93
2013/0255985 A1 * 10/2013 Zakuskin ..... B25D 9/10 173/209
2014/0208575 A1 * 7/2014 Jagdale ..... E02F 3/966 29/525.02
2015/0060100 A1 * 3/2015 Monroy ..... B25F 3/00 173/217
2015/0217419 A1 * 8/2015 Whitmer ..... E04H 17/263 173/128

* cited by examiner

QUICK CHANGE RAIL FASTENER DRIVING WORKHEAD UNIT

CROSS-REFERENCE

This application claims priority under 35 USC 119(e) from U.S. Provisional Application Ser. No. 61/867,874 filed Aug. 20, 2013.

BACKGROUND

The present disclosure generally relates to railroad right-of-way maintenance machinery, and more particularly relates to machinery used for driving fasteners into rail ties for securing rail tie plates and rails to the ties.

Rail fasteners as contemplated herein include cut spikes, lag screws, hairpin spikes and other types of rail fasteners used for retaining tie plates upon ties, and rails upon tie plates, as are known to skilled practitioners. In some cases in the specification, "spikes" may be used interchangeably with "rail fasteners." The use of the term "spikes" is not intended to limit the scope of the present invention.

During the course of railroad maintenance work, it is common that existing rail fasteners are removed for replacement of rail ties, tie plates, rails and for other maintenance operations. Once the desired maintenance is complete, the fasteners need to be reinstalled. For installing the fasteners, a conventional spike driving workhead unit employs an elongated shaft-like anvil which is vertically reciprocating relative to a spotting carriage to drive the fasteners into the ties. Under the upward and downward actions of a hydraulic impact hammer, the anvil repeatedly applies downward pressure upon spikes in a pushing or percussion function. After extended use, a spike engagement end of the anvil wears out and thus it needs to be replaced. To perform maintenance on the conventional spike driving workhead unit, a hole must be dug in the ballast so that conventional guide rods can be lowered below a hammer bushing, which is very inconvenient for replacement of the worn-out anvil.

Further, because the conventional guide rods are fastened with transverse threaded fasteners such as bolts, vibrations and impacts caused by the percussive actions of the hammer loosen and eventually shear the bolts. Spring pins are also used to fasten the guide rods to the jaw block, but as with the bolts the spring pins also fail due to the same reasons stated above. Failures of other moving components are also caused by manufacturing tolerances, thereby creating loose connections and improper alignments when assembled. Therefore, there is a need for securing a decreased chance of component failure and increasing serviceability of the conventional spike driving workhead unit during maintenance.

SUMMARY

The present disclosure is directed to a railway right-of-way maintenance machine having a spike driving workhead unit that is quickly changeable and easily disassembled for maintenance. Specifically, a lower portion of the spike driving workhead unit including an anvil assembly and a jaw assembly is detachable by unfastening associated clamps configured to releasably attach the members to the unit. A combination of three clamps with a specific geometry matingly engages corresponding components of the spike driving workhead unit.

One aspect of the machine is that, as described in further detail below, the geometry of each clamp allows securing the corresponding component in place by pivotally fastening the clamp with a biasing force. An indentation of the corresponding component mates with a matching indentation of the clamp to ensure that the component is properly installed and oriented in the unit. As a result, the clamp prevents linear and rotational movement of each component, and maintains its vertical and rotational alignments during operation.

Another important aspect is that the lower portion can be quickly and easily removed from the spike driving workhead unit for maintenance without ballast excavation. This removal is achieved by unfastening the three clamps and disassembling the unit in sequence. More specifically, after the unfastening of the clamps, guide rods are removed upwardly from the jaw assembly, and the lower portion is released from an impact hammer housing by removing a hammer pin from the housing. Once the lower portion is released from the unit, a worn-out anvil inside the anvil assembly is conveniently pulled out and replaced.

In one embodiment, a fastener driving workhead unit is provided for performing an operation on spikes of a railroad track having a plurality of ties, and includes a hammer housing configured for accommodating a hammer, the housing being attached to a hammer bushing having a hammer bushing clamp. Also included in the workhead unit is an anvil assembly having an anvil and an extension coupler, the extension coupler being releasably secured to the hammer bushing by fastening the hammer bushing clamp. Further, the workhead unit includes a jaw assembly having a jaw block, the jaw block having at least one jaw block clamp for releasably securing a guide rod to the jaw block by the jaw block clamp, such that the anvil freely reciprocates in the hammer housing for driving the spikes into the plurality of ties. In another embodiment, a method of disassembling a fastener driving workhead unit is provided, wherein the method includes releasing a plurality of jaw block clamps disposed on a jaw block of the fastener driving workhead unit; removing a plurality of guide rods connected to the jaw block after releasing the plurality of jaw block clamps; releasing a hammer bushing clamp disposed on a hammer bushing, which is connected to a hammer housing of the fastener driving workhead unit; removing a hammer pin from a keyway opening machined on a side wall of the hammer housing; and releasing an anvil assembly and a jaw assembly of the fastener driving workhead unit.

In still another embodiment, a clamp is provided for use in a railway fastener driving workhead. The clamp includes an elongate body having two ends, a finger pull disposed at at least one of the ends, a protrusion extending from an inner wall of body adjacent each end, the protrusions defining a central indentation therebetween and, with the body, forming a general "C" shape when viewed from above. A horizontal bore is defined in each protrusion.

DETAILED DESCRIPTION

Figure 1:
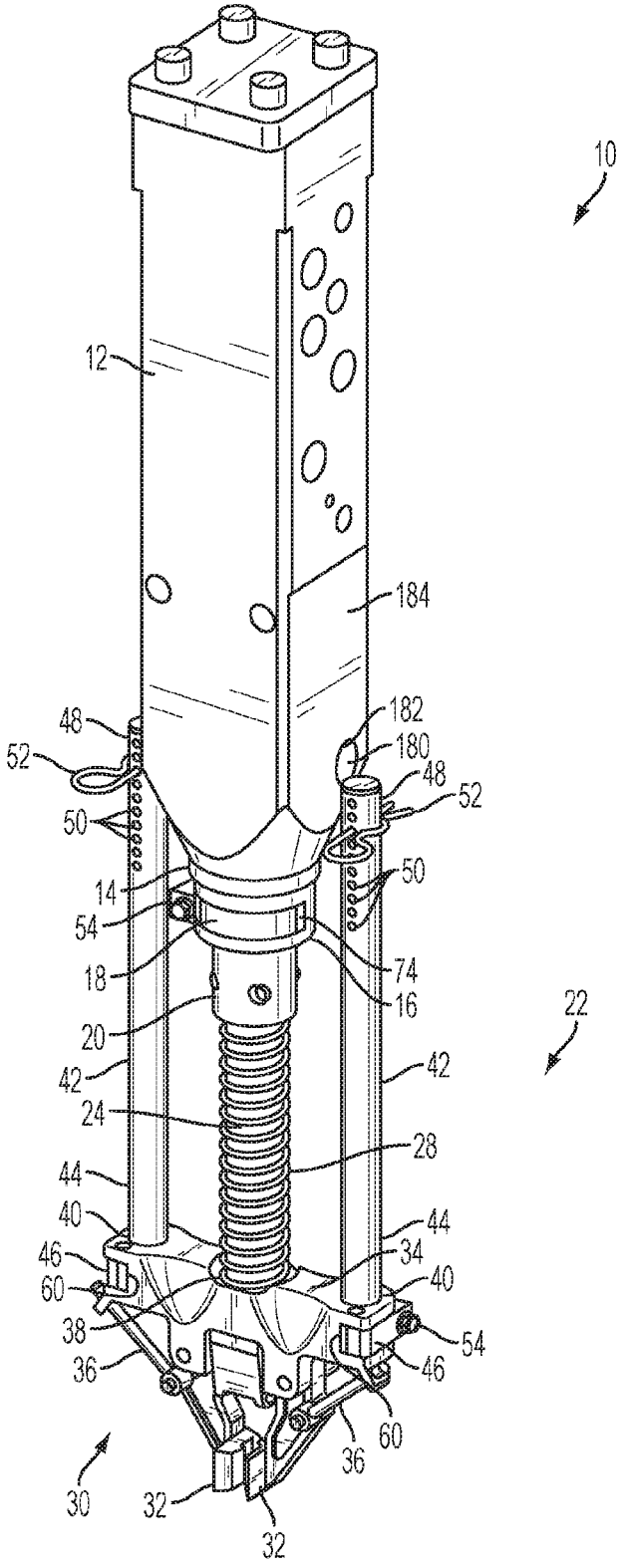
FIG. 1 is a top perspective view of the present spike driving workhead unit.

Referring now to FIG. 1, the present spike driving workhead unit is generally designated 10 and is designed to drive railroad spikes (not shown) into railroad ties (not shown). Several types of rail fastener applicators or drivers are known, and exemplary models are described in commonly assigned U.S. Pat. Nos. 4,579,061; 4,777,885; 5,191,840; 5,671,679; and 7,104,200, all of which are incorporated by reference herein. Included in the unit 10 is a hammer housing 12 for accommodating a hydraulic impact hammer (not shown) which is reciprocally vertically movable to drive the spikes into the ties. A lower end 14 of the hammer housing 12 is attached to a hammer bushing 16 having a hammer bushing clamp 18. While other suitable shapes are contemplated, it is preferred that the hammer bushing 16 has a substantially cylindrical shape for accommodating an extension coupler 20. The extension coupler 20 is releasably secured to the hammer bushing 16 by pivotally fastening the hammer bushing clamp 18 as described in further detail below.

An anvil assembly, generally designated 22, includes the extension coupler 20 at its upper end. Further included in the anvil assembly 22 is a tube-like anvil sleeve 24 that defines a passageway for a shaft-like anvil 26 (best shown in FIGS. 3-4) within the sleeve. In operation, the anvil 26 travels reciprocally vertically inside the sleeve 24 to matingly engage the head of the spike. Further included in the anvil assembly 22 is a spring 28 that surrounds the anvil sleeve 24, and is connected at one end to the extension coupler 20 and at an opposite end to a jaw assembly, generally designated 30. More specifically, the spring 28 biases at its upper end the extension coupler 20, and also biases at its lower end the jaw assembly 30. When the jaw assembly 30 is in an open position, the sleeve 24 holds the spike inside the sleeve during percussion, and subsequently the spike is driven into the tie.

Included in the jaw assembly 30 is a pair of spike gripping jaws 32 mounted to a jaw block 34 via a pair of rod eyes 36 to grasp the spike. In operation, the jaws 32 are pressurized toward the closed or gripping position by the rod eyes 36 which are hydraulically or mechanically biased, e.g., spring biased, as is well known in the art. To facilitate the reciprocal movement of the anvil 26, the jaw block 34 defines a central opening 38 through which the anvil passes to separate the jaws 32 and drive the spike into the tie as taught in U.S. Pat. No. 5,191,840, which is incorporated by reference.

Also included in the jaw block 34 is a plurality of throughbores 40, relatively smaller than the central opening 38, and each disposed for the vertical passage of the jaw block 34 that moves with a plurality of guide rods 42. The rods 42 guide a vertical movement of the anvil assembly 22 during percussing operation of the spike driving workhead unit 10. Also, the rods 42 guide the downward movement of the jaw assembly 30 to a spiking position. As is known in the art, the guide rods are slidingly engaged in corresponding bores of a workhead feeder frame of the type disclosed in U.S. Pat. No. 5,398,616, incorporated by reference. While other configurations are contemplated, it is preferred that two throughbores 40 are provided for the accommodation of two guide rods 42 for each spike driving workhead unit 10. A lower end 44 of each guide rod 42 matingly engages a corresponding throughbore 40, and is secured to the jaw block 34 by pivotally fastening a corresponding jaw block clamp 46 as described in further detail below. An upper end 48 of each guide rod 42 has a plurality of spaced apertures 50 for receiving a locking pin 52 to secure the rod to a weldment bracket (not shown).

During operation, the lower end 44 of each guide rod 42 is releasably attached to the jaw block 34 by fastening the corresponding jaw block clamp 46 using a transverse threaded fastener 54, such as a bolt. A rod indentation 56 (best shown in FIGS. 2-4) is disposed at each lower end 44 of the guide rod 42 for mating with a matching indentation of the jaw block clamp 46 as described in further detail below.

Typically, the spike driving workhead unit 10 is attached to a cylinder (not shown) via a sled (not shown) for upward and downward movements. A stroke range of the cylinder is between 18" and 19.5", but preferably 19.5". The sleeve 24 is firmly attached to the hammer housing 12 through the extension coupler 20 and the hammer bushing 16. The sleeve 24 travels in upward and downward directions along an operation axis of the hammer housing 12. Inside the sleeve 24 is the anvil 26, and it freely reciprocates in the hammer housing 12. The sleeve 24 is guided through the central opening 38.

The jaw assembly 30 and the guide rods 42 travel downwardly under the action of the spring 28 biasing between the extension coupler 20 and the jaw block 34. A purpose of the spring 28 is to keep the jaw assembly 30 and the guide rods 42 to travel at the same speed as the hammer housing 12, the sleeve 24, and the cylinder so that the spike is held securely. A length of the spring 28 does not change when the spike driving workhead unit 10 moves downwardly to the spiking position until the locking pins 52 hit the top of a bushing weldment (not shown). At this time, the sleeve 24, the hammer housing 12, and the anvil 26 continue to descend, and the spring 28 starts to compress. Then, the jaws 32, which are spring biased (not shown), start to open as the sleeve 24 is passing though the jaws. At this time, the spike driving workhead unit 10 receives resistance from the spike head, and this triggers the anvil 26 for driving the spike into the tie.

Figure 2:
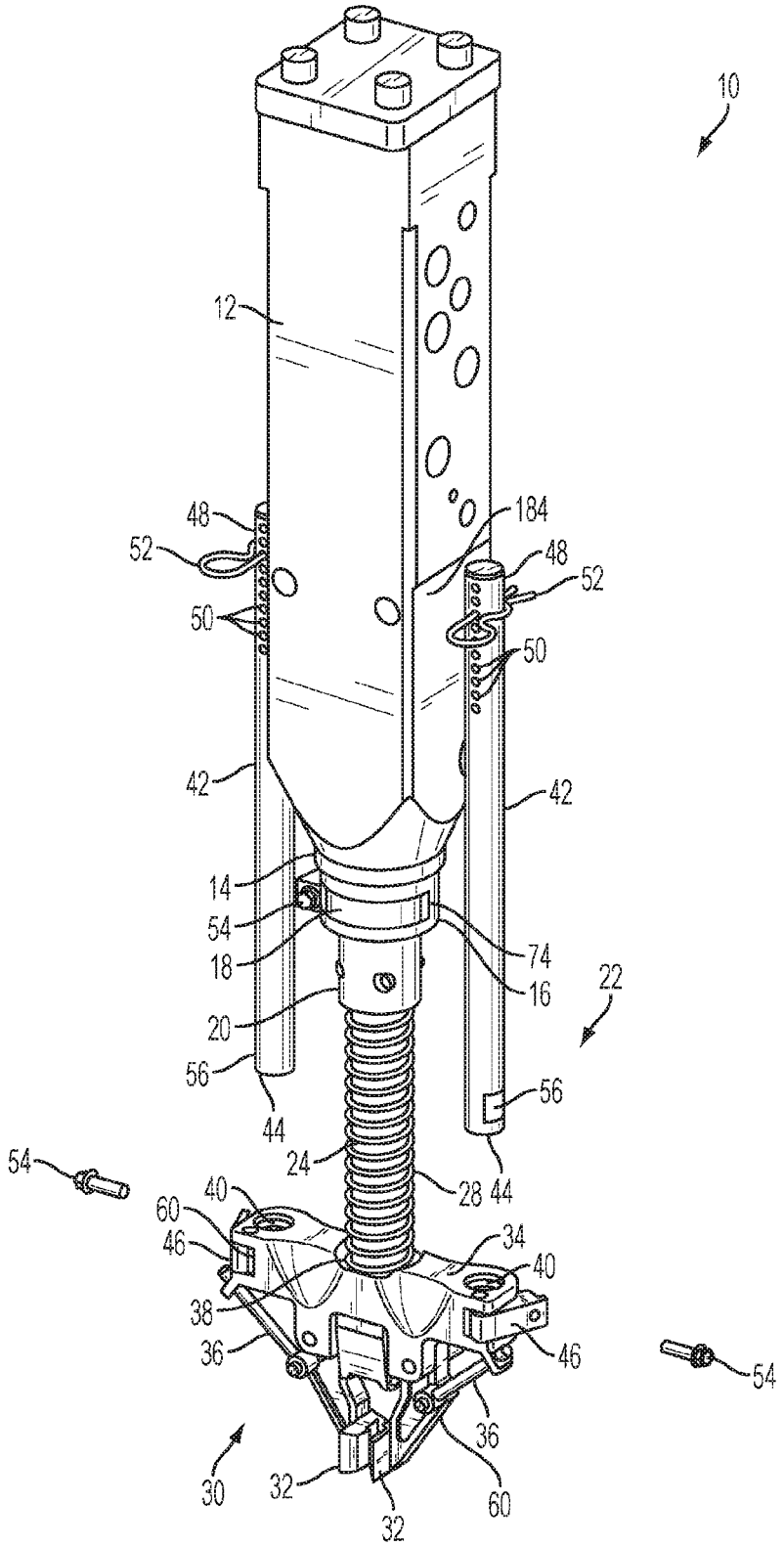
FIG. 2 is an exploded perspective view of the spike unit of FIG. 1 when jaw block clamps are unfastened.
Figure 5A:
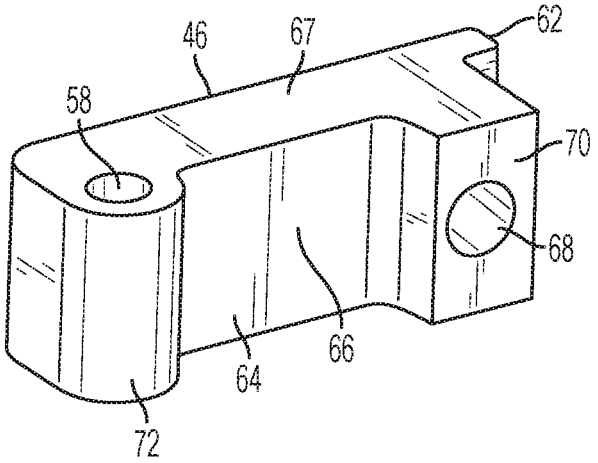
FIG. 5A is an inner perspective view of a jaw block clamp of the present unit.
Figure 5B:
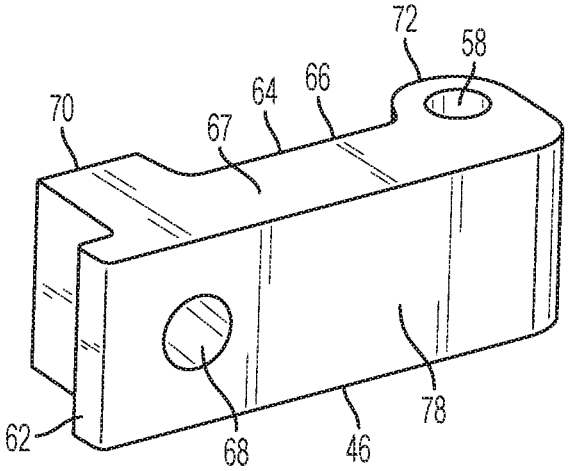
FIG. 5B is an outer perspective view of the jaw block clamp of FIG. 5A.

Referring now to FIGS. 2, 5A, and 5B, the geometry and functions of the jaw block clamp 46 are shown in further detail. A vertical bore 58 of each jaw block clamp 46 allows the jaw block clamp to pivot laterally about an axis of the vertical bore when the jaw block clamp is pushed into or pulled out of a corresponding jaw block side cavity 60 of the jaw block 34. Preferably, a finger pull 62 disposed opposite the vertical bore 58 is used for horizontal rotational manipulation of the jaw block clamp 46. Each side cavity 60 is configured to be in fluid communication with the throughbore 40 for receiving the guide rod 42. When the jaw block clamp 46 is fully pushed into the side cavity 60, a clamp or central indentation 64 disposed on an inner wall 66 of an elongated body 67 matingly engages the rod indentation 56 of the guide rod 42. Securing the jaw block clamp 46 into the jaw block side cavity 60 is achieved by rotationally fastening the bolt 54 through a horizontal bore 68 disposed transverse to the vertical bore 58 near the finger pull 62.

In the preferred embodiment, the jaw block clamp 46 has a first protrusion portion 70 at one end and a second protrusion portion 72 at an opposite end. Specifically, the first protrusion portion 70 having the horizontal bore 68 is generally rectangular or block-shaped and is disposed at one end of the jaw block clamp 46, and at an opposite end, the second protrusion portion 72 having the vertical bore 58. The second protrusion 72 is generally cylindrical in shape. Preferably, a width of the first protrusion portion 70 along the axis of the horizontal bore 68 is substantially the same with a corresponding width of the second protrusion portion 72. It is contemplated that the general shapes of the protrusions 70, 72 may vary to suit the application.

Additionally, the jaw block clamp 46 defines a generally "C"-shape when viewed from above in the orientation of FIG. 5A for fitting over the rod indentation 56 and locking the guide rod 42 in the throughbore 40. This configuration enables the jaw block clamp 46 to generate a squeezing force against the guide rod 42 when the jaw block clamp is tightened by rotationally fastening the bolt 54 through the horizontal bore 68 and into the jaw block 34. As a result, the clamp indentation 64 of the jaw block clamp 46 is slightly bent to firmly directly bias the rod indentation 56 of the guide rod 42, thereby ensuring a proper installation and orientation of the guide rod 42 in the jaw block 34.

Figure 3:
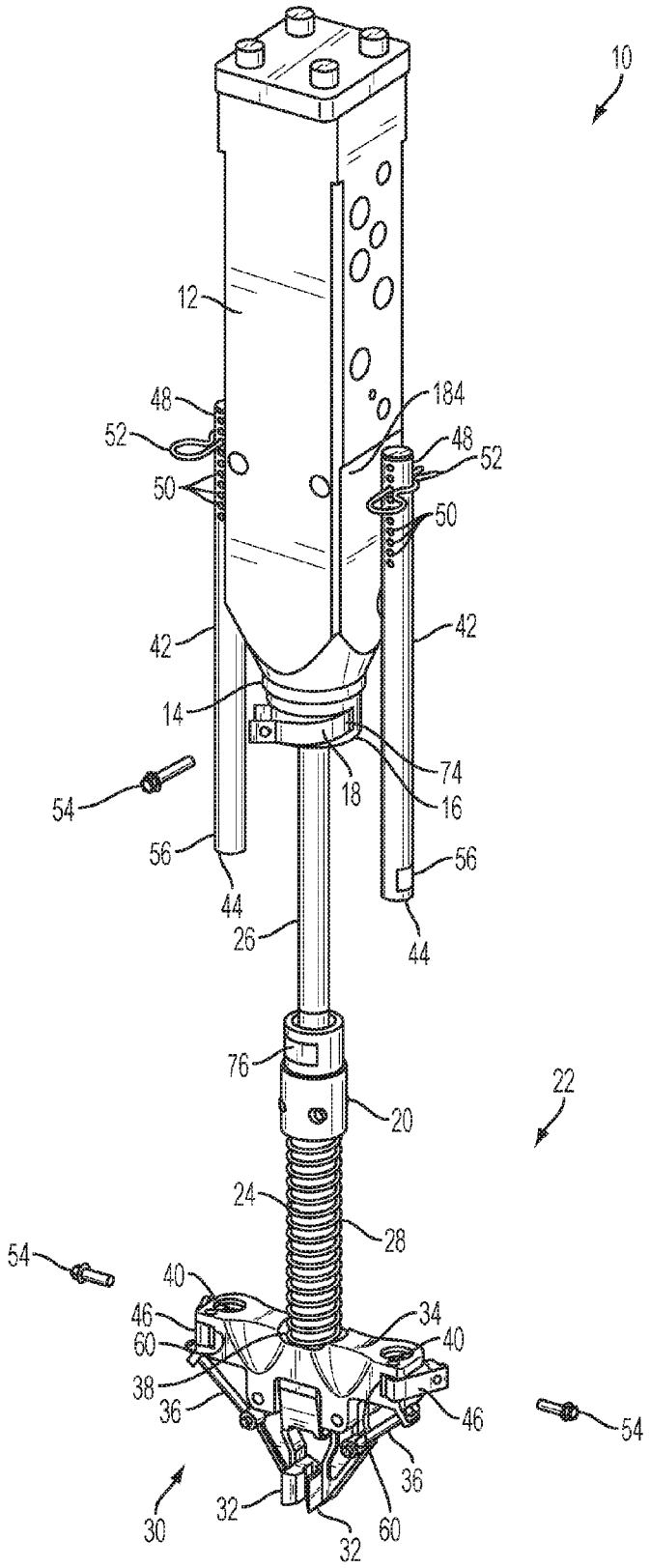
FIG. 3 is an exploded perspective view of the spike unit of FIG. 2 when a hammer bushing clamp is unfastened.
Figure 6A:
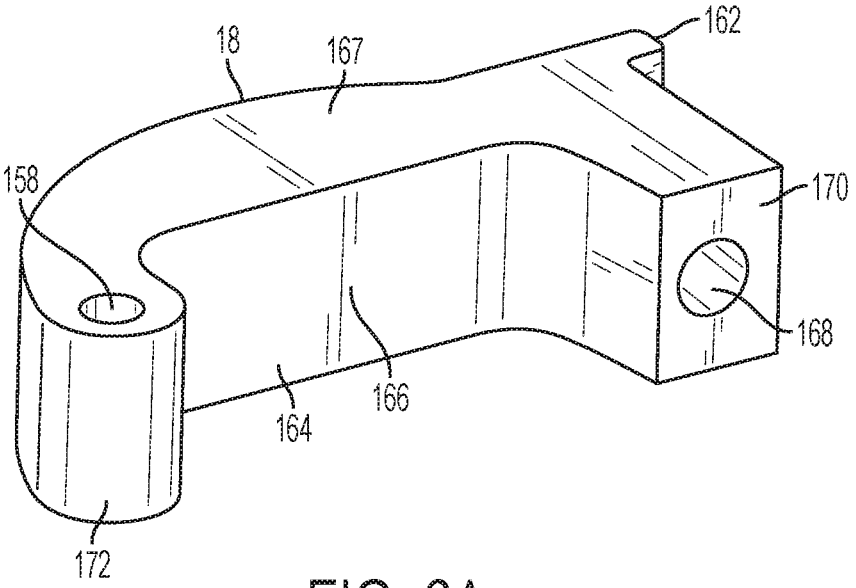
FIG. 6A is an inner perspective view of a hammer bushing clamp of the present unit.
Figure 6B:
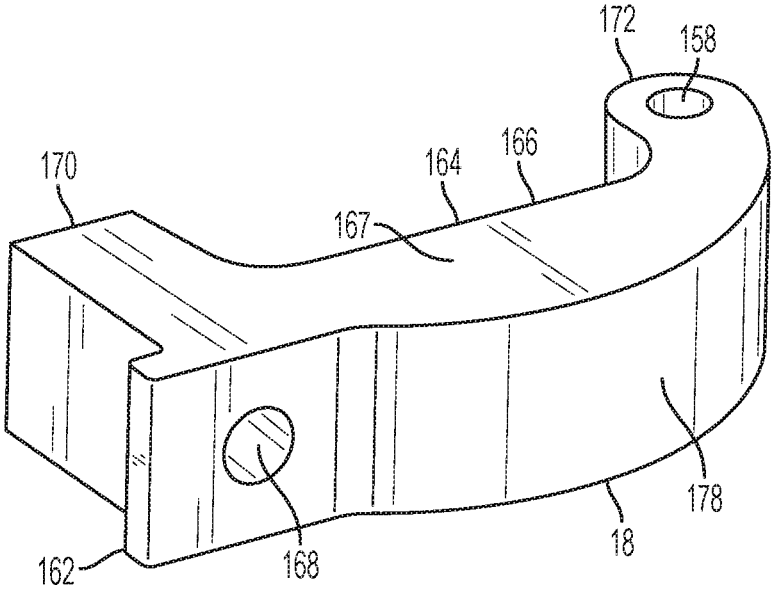
FIG. 6B is an outer perspective view of the hammer bushing clamp of FIG. 6A.

Referring now to FIGS. 3, 6A, and 6B, the geometry and functions of the hammer bushing clamp 18 are shown in further detail. Both the hammer bushing clamp 18 and the jaw block clamp 46 share similar features, and components shared with the spike driving workhead unit 10 are designated with identical reference numbers. As is the case with the jaw block clamp 46, a vertical bore 158 of each hammer bushing clamp 18 allows the hammer bushing clamp to pivot laterally about an axis of the vertical bore when the hammer bushing clamp is pushed into or pulled out of a bushing side cavity 74 of the hammer bushing 16.

Preferably, as shown in FIGS. 6A-6B, a finger pull 162 disposed opposite the vertical bore 158 is used for horizontal rotational manipulation of the hammer bushing clamp 18. The side cavity 74 is configured to be in fluid communication with the hammer housing 12 for receiving the extension coupler 20. When the hammer bushing clamp 18 is fully pushed into the side cavity 74, a clamp indentation 164 disposed on an inner wall 166 of an elongated body 167 matingly engages a coupler indentation 76 of the extension coupler 20. Securing the hammer bushing clamp 18 into the bushing side cavity 74 is achieved by rotationally fastening the bolt 54 through a horizontal bore 168 disposed transverse to the vertical bore 158 and near the finger pull 162.

Similarly, with the jaw block clamp 46, the hammer bushing clamp 18 has a first protrusion portion 170 at one end and a second protrusion portion 172 at an opposite end. Specifically, the first protrusion portion 170 having the horizontal bore 168 is disposed at one end of the hammer bushing clamp 18, and at an opposite end, the second protrusion portion 172 having the vertical bore 158. Preferably, a width of the first protrusion portion 170 along the axis of the horizontal bore 168 is substantially the same with a corresponding width of the second protrusion portion 172.

Additionally, the hammer bushing clamp 18 also defines a generally "C"-shape when viewed from above in the orientation of FIG. 6A for fitting over the coupler indentation 76 and locking the extension coupler 20 in the hammer bushing 16. Similar methods described above for securing the jaw block clamp 46 are employed here for the hammer bushing clamp 18. Further detailed description of the jaw block clamp 46 and the hammer bushing clamp 18 is provided below in FIGS. 7 and 8.

Referring now to FIGS. 5-6, although both the hammer bushing clamp 18 and the jaw block clamp 46 share similar features as described above, an outer wall 78 of the jaw block clamp 46 has a planar surface, and an outer wall 178 of the hammer bushing clamp 18 has a contoured surface to conform to the surrounding surfaces of adjacent components of the spike driving workhead unit 10. Other suitable configurations are also contemplated.

Referring now to FIGS. 2-4, an exemplary disassembling sequence of the spike driving workhead unit 10 is illustrated. While the following sequence is primarily described with respect to the embodiment of FIG. 1, it should be understood that the steps within the sequence may be modified and executed in a different order or manner without altering the principles of the present disclosure. During maintenance, as shown in FIG. 2, the jaw block clamps 44 are initially loosened by rotationally removing the bolts 54 from the horizontal bore 68 of the jaw block 34, thereby releasing the guide rods 42 from the jaw block 34 and allowing the rods to be removed upwardly.

Next, as shown in FIG. 3, the hammer bushing clamp 18 is similarly loosened by rotationally removing the bolt 54 from the hammer bushing 16, thereby releasing the extension coupler 20 from the hammer bushing 16 and allowing the anvil assembly 22 and the jaw assembly 30 to be lowered downwardly from the lower end 14 of the hammer housing 12. For example, the anvil and jaw assemblies 22, 30 can be lowered onto the tie for inspection without requiring ballast excavation.

Figure 4A:
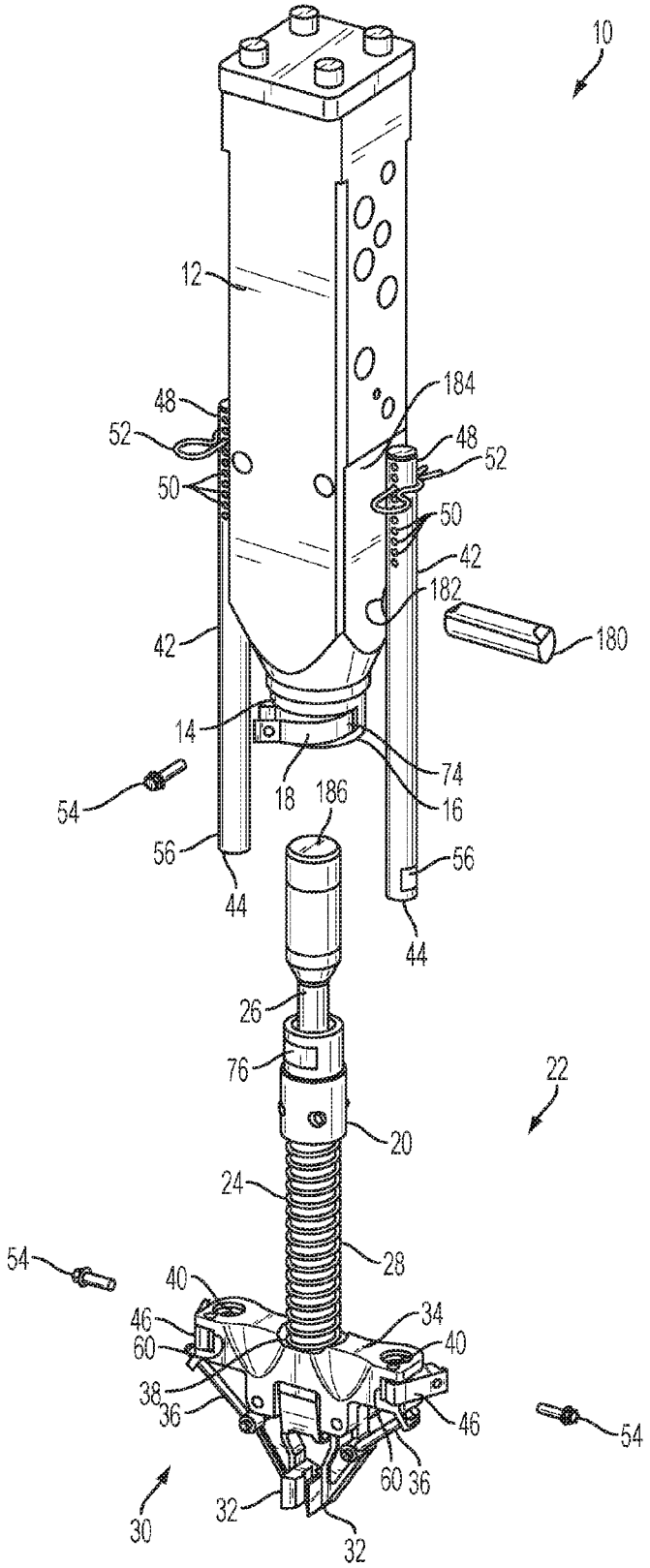
FIG. 4A is a front exploded perspective view of the spike unit of FIG. 3 when a hammer pin is removed.
Figure 4B:
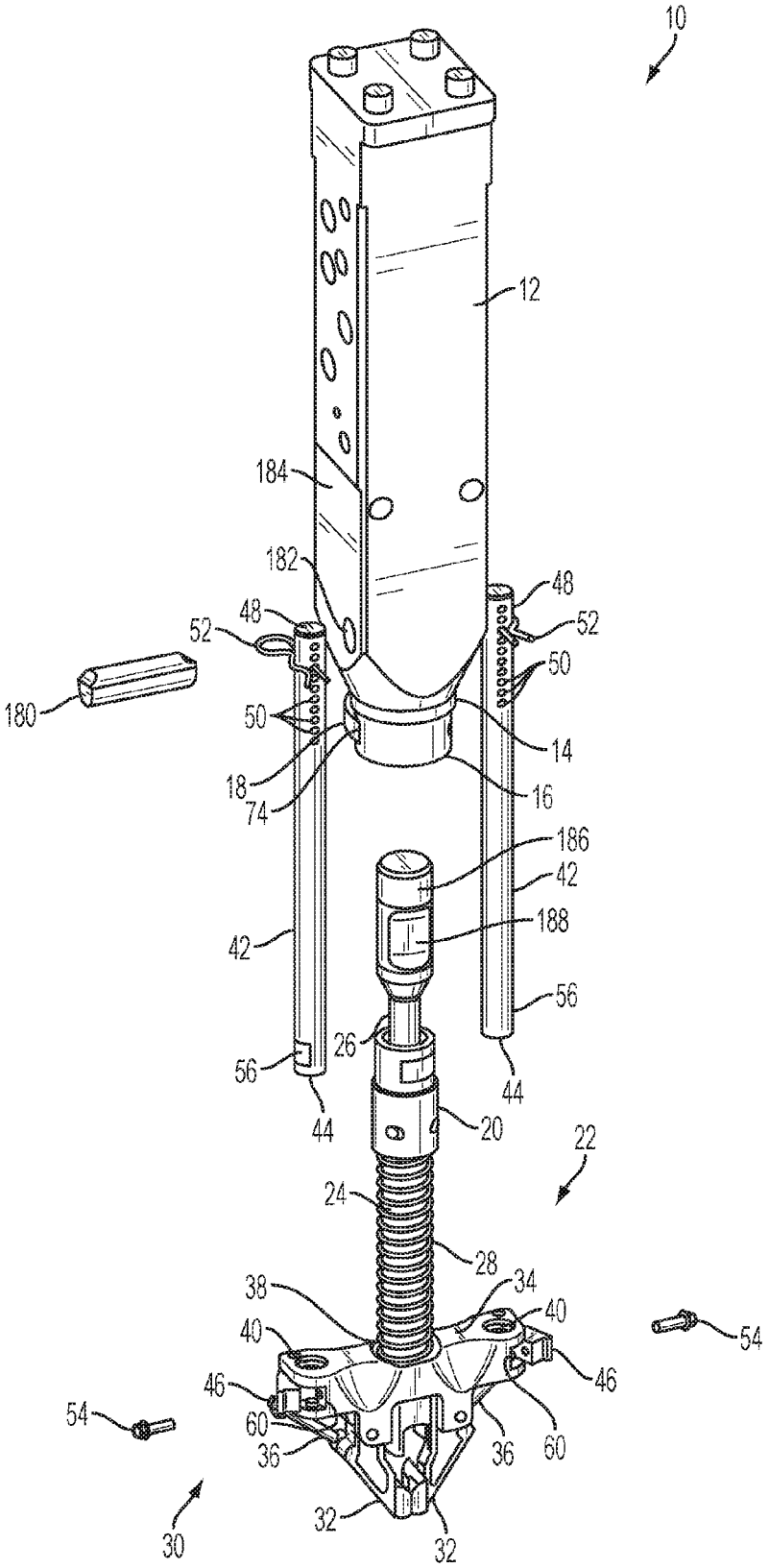
FIG. 4B is a rear exploded perspective view of the spike unit of FIG. 4A.

At this stage, both the anvil assembly 22 and the jaw assembly 30 are still connected to the hammer housing 12 via the anvil 26. Releasing of the anvil 26 from the hammer housing 12 is achieved, as shown in FIG. 4A, by removing a hammer pin 180 from a keyway opening 182 machined on one of the side walls 184 of the hammer housing 12. Specifically, an upper end 186 of the anvil 26 has an anvil indentation 188 (FIG. 4B) that mates with the hammer pin 180. As best shown in FIG. 4B, the hammer pin 180 preferably has a cylindrical shape with a guiding planar upper surface and is configured for mating with the anvil indentation 188 when the hammer pin is inserted into the keyway opening 182. Upon removal of the hammer pin 180, the anvil and jaw assemblies 22, 30 are removed from the spike driving workhead unit 10 for maintenance. Thus, the disassembled components, such as a worn-out anvil, can then be readily replaced. Reassembling of the disassembled components is achieved by applying a reverse sequence of the above-described steps.

Figure 7A:
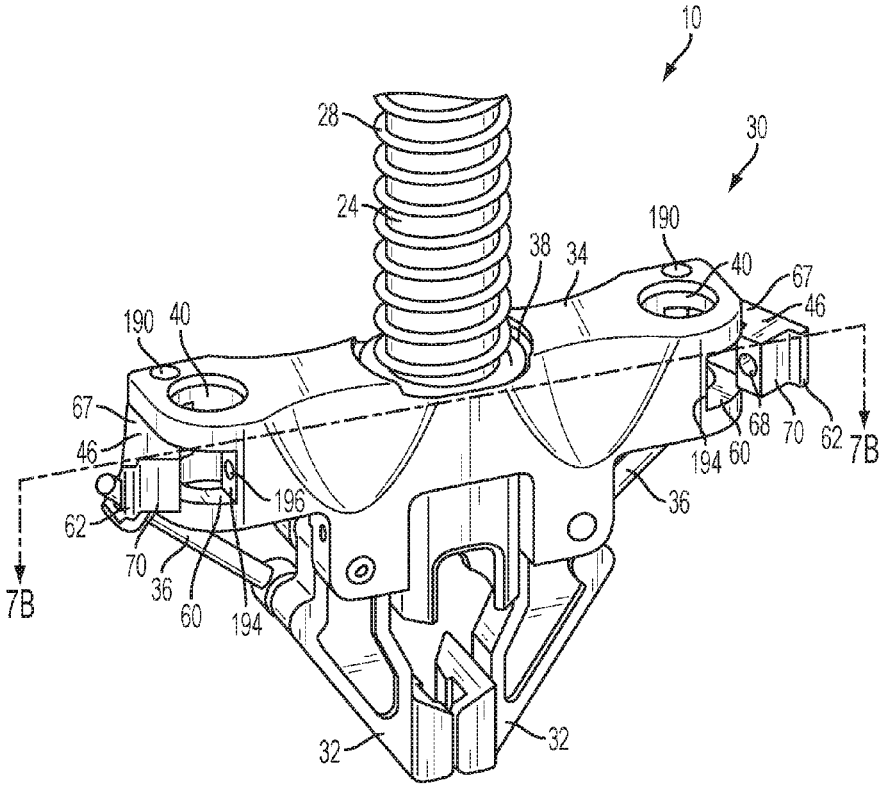
FIG. 7A is an enlarged perspective view of the present jaw assembly featuring the present jaw block.
Figure 7B:
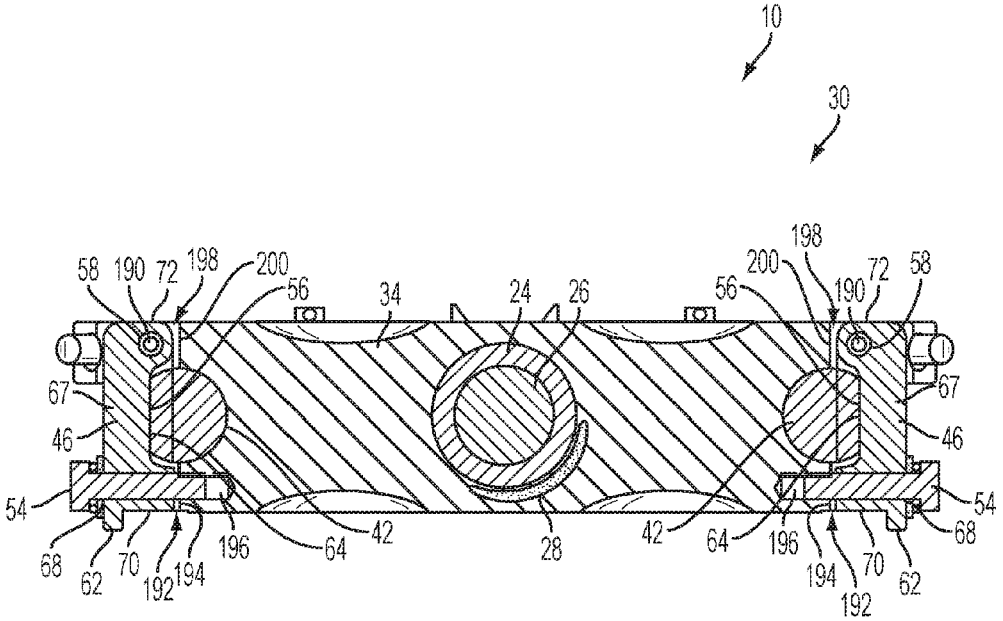
FIG. 7B is a cross-sectional view of the present jaw block taken generally along the line A-A in FIG. 7A and in the direction generally indicated.

Referring now to FIGS. 7A-7B, the detailed geometry and functions of the jaw block clamp 46 is shown. When the jaw block clamp 46 pivots about a pivot pin 190 disposed in the vertical core 58 of the jaw block clamp 46, the clamp indentation 64 firmly biases against the rod indentation 56 of the guide rod 42 for securely locking the rod. An important aspect of this configuration is that when the jaw block clamp 46 is pushed into the corresponding jaw block side cavity 60, a first clearance, generally designated 192, is defined between the first protrusion portion 70 and a first inner wall 194 of the jaw block side cavity 60.

As a result, the first clearance 192 enables the jaw block clamp 46 to generate a squeezing force against the rod indentation 56 by bending or deforming the elongated body 67 of the jaw block clamp when the bolt 54 is rotationally fastened through the horizontal bore 68 and into a corresponding bore 196 disposed on the first inner wall 194. A second clearance, generally designated 198, is defined between the second protrusion portion 72 and a second inner wall 200 of the jaw block side cavity 60, thereby allowing free pivoting actions of the jaw block clamp 46 during a clamping process.

Figure 8A:
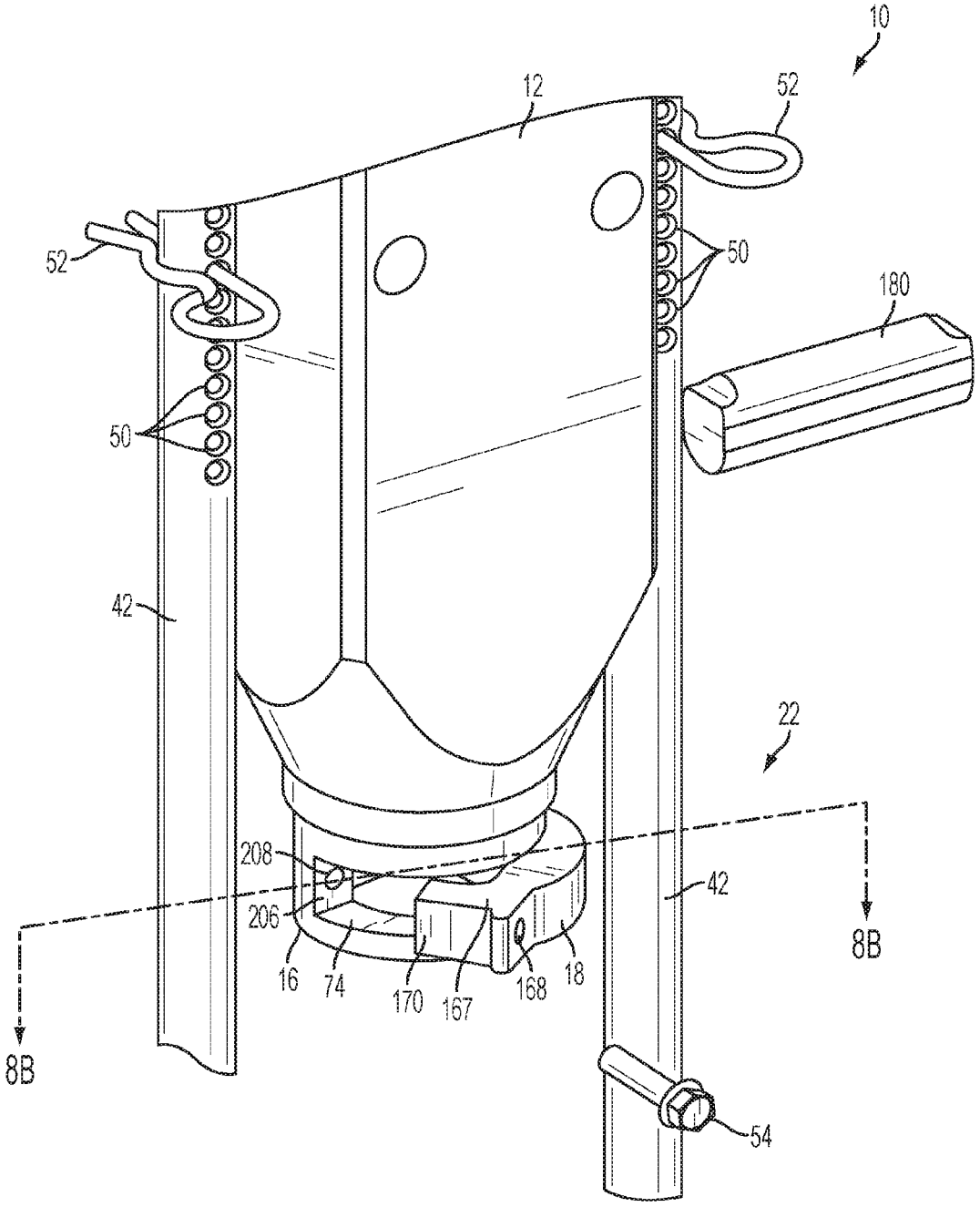
FIG. 8A is an enlarged perspective view of the present anvil assembly featuring the present hammer bushing.
Figure 8B:
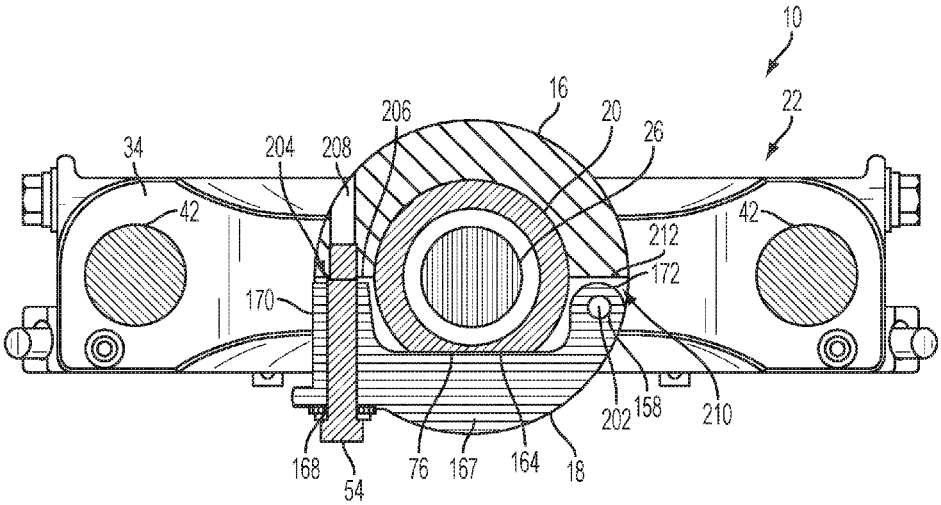
FIG. 8B is a cross-sectional view of the present hammer bushing taken generally along the line B-B in FIG. 8A and in the direction generally indicated.

Referring now to FIGS. 8A-8B, the detailed geometry and functions of the hammer bushing clamp 18 is shown. As is the case with the jaw block clamp 46, when the hammer bushing clamp 18 pivots about a pivot pin 202 disposed in the vertical core 158 of the hammer bushing clamp 18, the clamp indentation 164 firmly biases against the coupler indentation 76 of the extension coupler 20 for securely locking the coupler. An important aspect of this configuration is that when the hammer bushing clamp 18 is pushed into the corresponding bushing side cavity 74, a first clearance, generally designated 204, is defined between the first protrusion portion 170 and a first inner wall 206 of the busing side cavity 74.

As a result, the first clearance 204 enables the hammer bushing clamp 18 to generate a squeezing force against the coupler indentation 76 by bending or deforming the elongated body 167 of the hammer bushing clamp when the bolt 54 is rotationally fastened through the horizontal bore 168 and into a corresponding bore 208 disposed on the first inner wall 206. A second clearance, generally designated 210, is defined between the second protrusion portion 172 and a second inner wall 212 of the bushing side cavity 74, thereby allowing free pivoting actions of the hammer bushing clamp 18 during the clamping process.

Figure 9A:
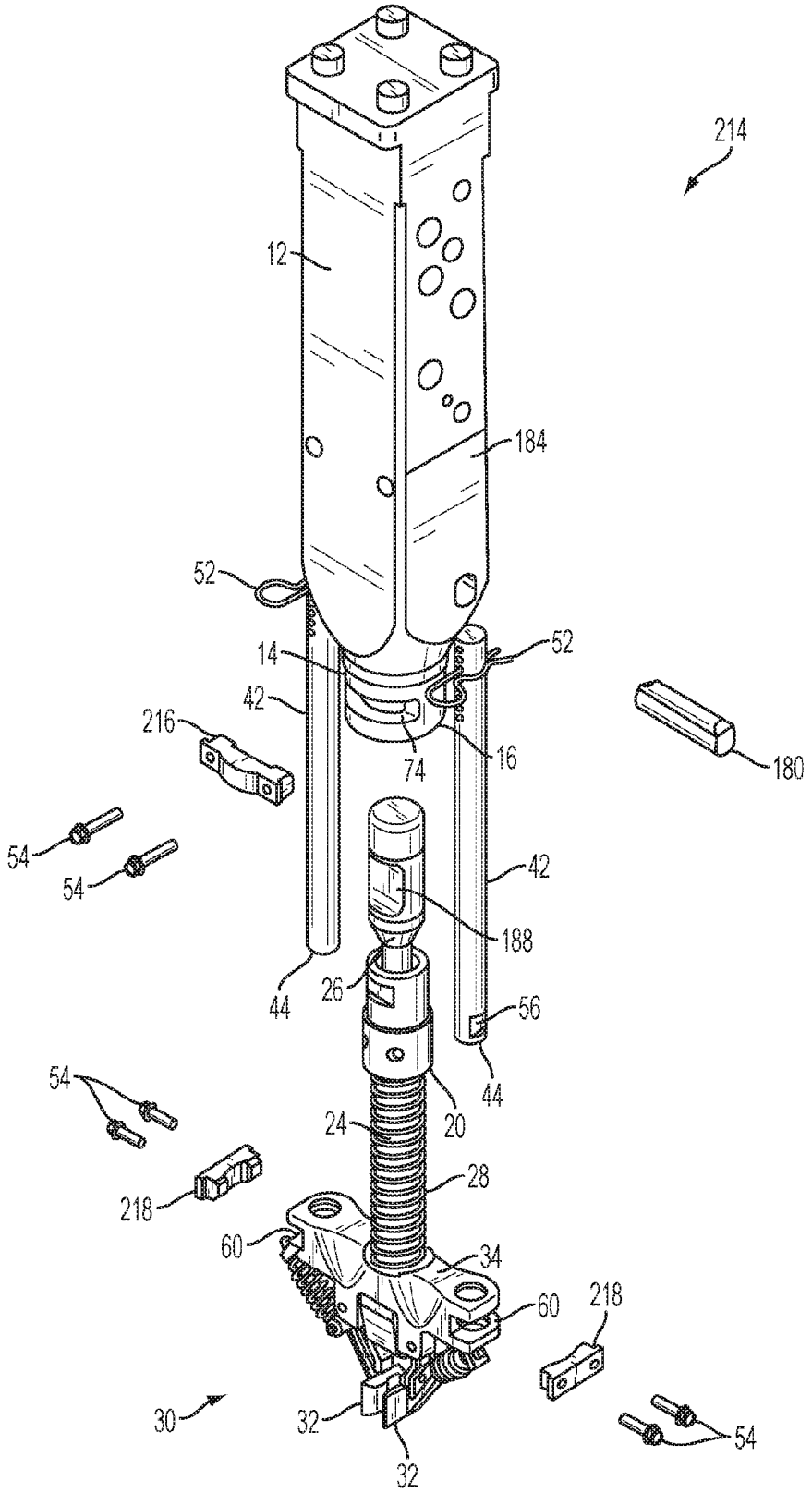
FIG. 9A is a front exploded perspective view of the spike unit of FIG. 3 featuring a second embodiment of the jaw block clamp and a second embodiment of the hammer bushing clamp.
Figure 9B:
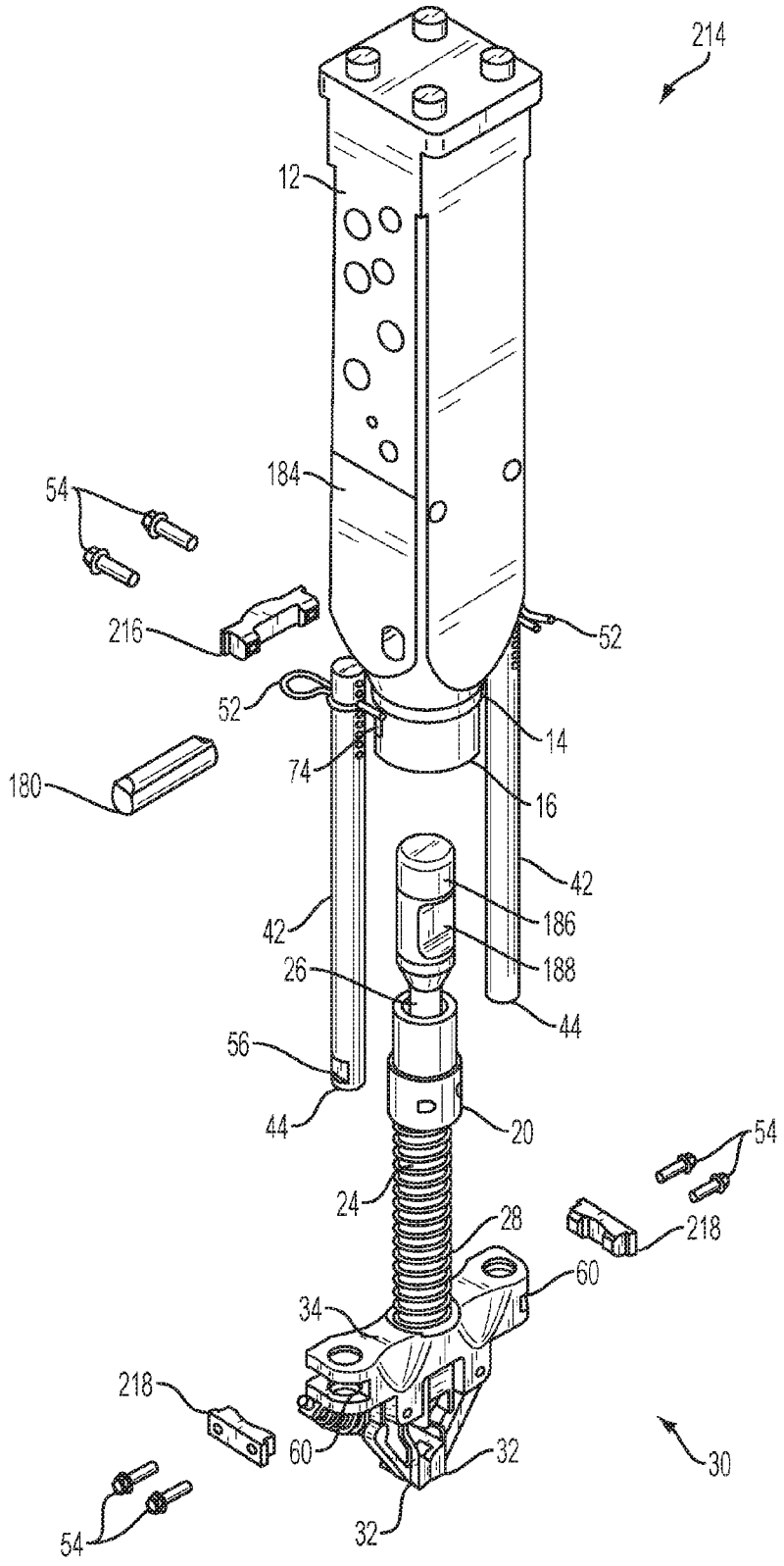
FIG. 9B is a rear exploded perspective view of the spike unit of FIG. 9A.

Referring now to FIGS. 2, 9A and 9B, another embodiment of the present spike driving workhead unit 10 is generally designated 214. Components shared with the unit 10 are designated with identical reference numbers. A major difference featured in the unit 214 is that the unit is equipped with another embodiment of the hammer bushing clamp 18 designated 216, and another embodiment of the jaw block clamp 46 designated 218. An important feature of the unit 214 is that the hammer bushing clamp 216 is secured to the bushing side cavity 74 using two bolts 54, and similarly, the jaw block clamp 218 is secured to the jaw block side cavity 60 using two bolts 54. Notably, both clamps 216, 218 are secured to the workhead unit 214 without pivotal manipulation as is the case with the clamps 18, 46 shown in FIGS. 4A and 4B. Detailed description of the configurations of the hammer bushing clamp 216 and the jaw block clamp 218 is provided below.

Figure 10A:
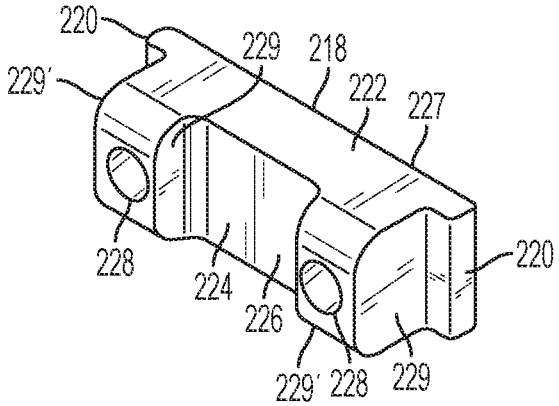
FIG. 10A is an inner perspective view of the jaw block clamp of FIG. 9A.
Figure 10B:
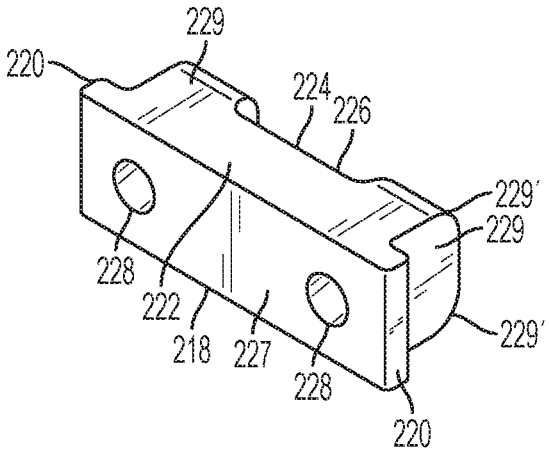
FIG. 10B is an outer perspective view of the jaw block clamp of FIG. 9A.

Referring now to FIGS. 9A, 10A and 10B, the geometry and functions of the jaw block clamp 218 are shown in further detail. The jaw block clamp 218 operates generally in a similar manner as the jaw block clamp 46 shown in FIGS. 5A and 5B. For pushing into or pulling out of the corresponding jaw block side cavity 60 of the jaw block 34, at least one finger pull 220 is disposed at an end of an elongated body 222 of the jaw block clamp 218. When the jaw block clamp 218 is fully pushed into the side cavity 60, a clamp or central indentation 224 disposed on an inner wall 226 of the elongated body 222 matingly engages the rod indentation 56 of the guide rod 42. An outer wall 227 is opposite the inner wall 226 and is in spaced, parallel relation thereto.

Securing the jaw block clamp 218 into the jaw block side cavity 60 is achieved by rotationally fastening two bolts 54 through corresponding horizontal bores 228 disposed in generally rectangular or block-shaped protrusions 229 at opposite ends of the elongate body 222 near the corresponding finger pull 220. It will be seen that the protrusions 229 extend from the inner wall 226 of the elongate body 222 corresponding to the central indentation 224, and each preferably has radiused portions 229' located above and below the bores 228. It is contemplated that the radiused portions 229' can optionally be provided to the hammer bushing clamp 18 and the jaw block clamp 46 described above in relation to FIGS. 5A and 5B and 6A and 6B. As is the case with the jaw block clamp 46, the protrusions 229 and the elongated body 222 combine to define a general "C" shape when viewed from above as seen in FIGS. 10A and 10 B.

Figure 11A:
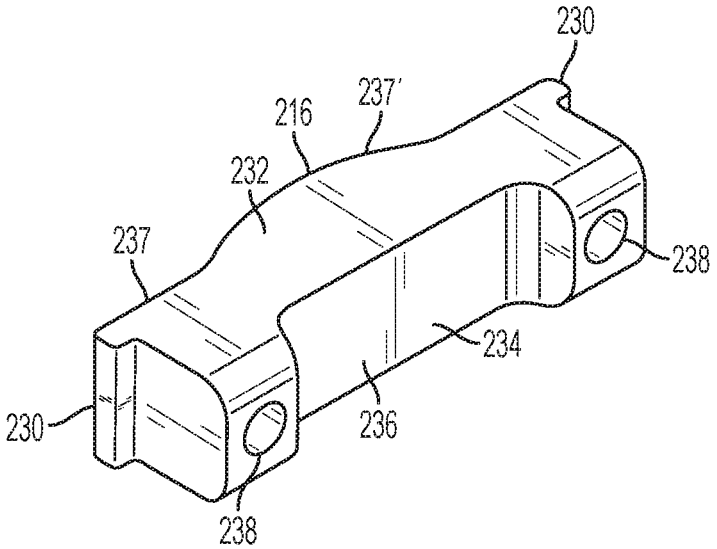
FIG. 11A is an inner perspective view of the hammer bushing clamp of FIG. 9A.
Figure 11B:
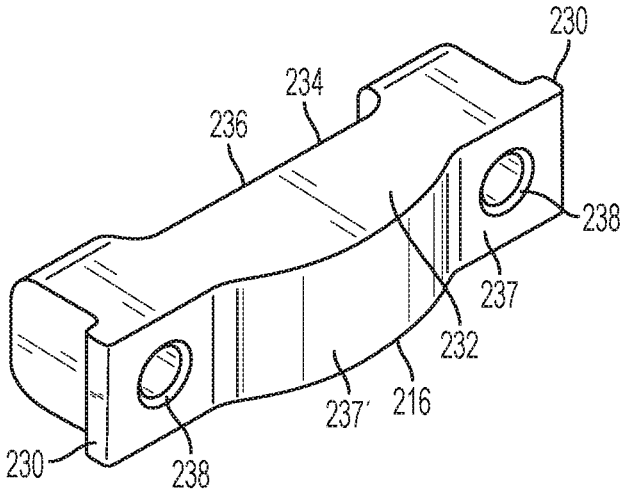
FIG. 11B is an outer perspective view of the hammer bushing clamp of FIG. 9A.

Referring now to FIGS. 9B, 11A, and 11B, the geometry and functions of the hammer bushing clamp 216 are shown in further detail. The hammer bushing clamp 216 operates generally in a similar manner as the hammer bushing clamp 18 shown in FIGS. 6A and 6B. Similarly with the jaw block clamp 218, to push into or pull out of the bushing side cavity 74, at least one finger pull 230 is disposed at an end of an elongate body 232 of the hammer bushing clamp 216. When the hammer bushing clamp 216 is fully pushed into the bushing side cavity 74, a clamp or central indentation 234 disposed on an inner wall 236 of the elongated body 232 matingly engages the anvil indentation 188 of the anvil 26.

An outer wall 237 is in spaced parallel relation to the inner wall 236 and defines a general concave portion 237'. Securing the hammer bushing clamp 216 into the bushing side cavity 74 is achieved by rotationally fastening two bolts 54 through corresponding horizontal bores 238 extending transversely to the elongated body 232 disposed in block-shaped or rectangular protrusions 239 at opposite ends of the elongate body near the corresponding finger pull 230. The generally concave portion 237' is located between the bores 238. Also, as is the case with the jaw block clamp 218, the protrusions 239 head define radiused edges 240 above and below the bores 238. Also, as is the case with the hammer bushing clamp 18, and the jaw block clamp 46, the protrusions 229 and the elongated body 232 combine to define a general "C" shape when viewed from above as seen in FIGS. 11A and 11 B.

While a particular embodiment of the present spike driving workhead unit has been described herein, it will be appreciated by those skilled in the art that changes and modifications may be made thereto without departing from the present disclosure in its broader aspects and as set forth in the following claims.

What is claimed is:

1. A fastener driving workhead unit for performing an operation on spikes of a railroad track having a plurality of ties, comprising:

a hammer housing configured for accommodating a hammer, the housing being attached to a hammer bushing having a hammer bushing clamp;

an anvil assembly having an anvil and an extension coupler, the extension coupler being releasably secured to the hammer bushing by fastening the hammer bushing clamp;

a jaw assembly having a jaw block, the jaw block having at least one jaw block clamp for releasably securing a guide rod to the jaw block by the jaw block clamp, such that the anvil freely reciprocates in the hammer housing for driving the spikes into the plurality of ties; and each said jaw block clamp is configured for insertion into a corresponding jaw block side cavity of the jaw block, and the side cavity of the jaw block is configured to be in fluid communication with a corresponding throughbore of the jaw block for receiving the guide rod.

2. The fastener driving workhead unit of claim 1, wherein the at least one jaw block clamp has a vertical bore for allowing the jaw block clamp to pivot laterally about an axis of the vertical bore.

3. The fastener driving workhead unit of claim 2, wherein a finger pull disposed opposite the vertical bore is used for horizontal rotational manipulation of the at least one jaw block clamp.

4. The fastener driving workhead unit of claim 1, wherein a central indentation disposed on an inner wall of an elongated body of the at least one jaw block clamp matingly engages a rod indentation of the guide rod when the jaw block clamp is fully pushed into the side cavity.

5. The fastener driving workhead unit of claim 3, wherein a horizontal bore is disposed transverse to the vertical bore near the finger pull for securing the at least one jaw block clamp to the jaw block by fastening a fastener through the horizontal bore.

6. The fastener driving workhead unit of claim 1, wherein the at least one jaw block clamp has a first protrusion portion at one end, and a second protrusion portion at an opposite end, at least the first protrusion portion having a horizontal bore.

7. The fastener driving workhead unit of claim 1, wherein the at least one jaw block clamp defines a generally "C"-shape when viewed from above for fitting over a rod indentation of the guide rod and locking the guide rod in a throughbore of the jaw block.

8. The fastener driving workhead unit of claim 6, wherein a first clearance is defined between the first protrusion portion and a first inner wall of a jaw block side cavity of the jaw block when the at least one jaw block clamp is pushed into the corresponding jaw block side cavity.

9. The fastener driving workhead unit of claim 8, wherein the first clearance enables the at least one jaw block clamp to generate a squeezing force against a rod indentation of the guide rod by bending or deforming an elongated body of the jaw block clamp.

10. The fastener driving workhead unit of claim 1, wherein the hammer bushing clamp defines a generally "C"-shape when viewed from above for fitting over a rod indentation of the guide rod and locking the guide rod in a throughbore of the jaw block.

11. The fastener driving workhead unit of claim 1, wherein the hammer bushing clamp is dimensioned for insertion into a bushing side cavity of the hammer bushing.

12. The fastener driving workhead unit of claim 10, wherein a finger pull disposed is used for horizontal rotational manipulation of the hammer bushing clamp.

13. The fastener driving workhead unit of claim 11, wherein a clamp indentation disposed on an inner wall of an elongated body of the hammer bushing clamp matingly engages a coupler indentation of the extension coupler when the hammer bushing clamp is fully pushed into the bushing side cavity.

14. The fastener driving workhead unit of claim 1, wherein the hammer bushing has a first protrusion portion at one end, and a second protrusion portion at an opposite end, at least the first protrusion portion having a horizontal bore.

15. The fastener driving workhead unit of claim 14, wherein a first clearance is defined between the first protrusion portion and a first inner wall of a bushing side cavity of the hammer bushing when the hammer bushing clamp is pushed into the corresponding bushing side cavity; and a second clearance is defined between the second protrusion portion and a second inner wall of the bushing side cavity of the hammer bushing for allowing insertion of the hammer bushing clamp during a clamping process.

16. A fastener driving workhead unit for performing an operation on spikes of a railroad track having a plurality of ties, comprising:

a hammer housing configured for accommodating a hammer, the housing being attached to a hammer bushing having a hammer bushing clamp;

an anvil assembly having an anvil and an extension coupler, the extension coupler being releasably secured to the hammer bushing by fastening the hammer bushing clamp;

a jaw assembly having a jaw block, the jaw block having at least one jaw block clamp for releasably securing a guide rod to the jaw block by the jaw block clamp, such that the anvil freely reciprocates in the hammer housing for driving the spikes into the plurality of ties; and wherein the hammer bushing clamp is dimensioned for insertion into a bushing side cavity of the hammer bushing.

* * * * *